United States Patent [19]

Tomioka et al.

[11] Patent Number: 4,525,137

[45] Date of Patent: Jun. 25, 1985

[54] LIQUID FUEL COMBUSTION DEVICE

[75] Inventors: Mitsuharu Tomioka, Kashihara; Mitsuhiro Imajima, Yamatokoriyama, both of Japan

[73] Assignee: Matsushita Electric Industrial Co., Ltd., Osaka, Japan

[21] Appl. No.: 451,211

[22] PCT Filed: Apr. 5, 1982

[86] PCT No.: PCT/JP82/00102

§ 371 Date: Nov. 22, 1982

§ 102(e) Date: Nov. 22, 1982

[87] PCT Pub. No.: WO82/03444

PCT Pub. Date: Oct. 14, 1982

[30] Foreign Application Priority Data

Apr. 6, 1981 [JP] Japan ..... 56-51462
Apr. 9, 1981 [JP] Japan ..... 56-54134

[51] Int. Cl.[3] ..... F23N 5/00

[52] U.S. Cl. ..... 431/76; 431/75; 431/196; 431/208; 431/14; 126/96; 126/116 A

[58] Field of Search ..... 431/75, 36, 76, 37, 431/11, 33, 80, 78, 14, 207, 208, 196, 206, 203, 242; 126/116 A, 95, 96; 236/15 E; 340/632, 633, 595, 599; 374/36, 37

[56] References Cited

U.S. PATENT DOCUMENTS

| | | | |
|---|---|---|---|
| 2,062,556 | 12/1936 | Chittick | 431/196 |
| 2,129,239 | 9/1938 | Rook et al. | 431/196 |
| 2,418,182 | 4/1947 | McCollum | 126/116 A |
| 3,061,826 | 10/1962 | Willenborg | 340/633 X |
| 3,102,577 | 9/1963 | Dekker | 431/196 X |
| 3,175,397 | 3/1965 | Niedergesass | 374/37 |
| 3,472,071 | 10/1969 | Toyoda | 374/36 |
| 3,608,505 | 9/1971 | Rosenberg | 431/37 X |
| 3,756,764 | 9/1973 | Reichmann | 431/208 X |
| 3,882,451 | 5/1975 | Fujishiro et al. | 340/595 X |
| 4,265,611 | 5/1981 | Reed et al. | 431/29 X |
| 4,315,430 | 2/1982 | Szonntagh | 374/37 |
| 4,392,813 | 7/1983 | Tanaka | 431/176 |

FOREIGN PATENT DOCUMENTS

| | | | |
|---|---|---|---|
| 0050287 | 4/1982 | European Pat. Off. . | |
| 113925 | 9/1981 | Japan | 431/313 |
| 2925 | 1/1982 | Japan | 431/313 |
| 2924 | 1/1982 | Japan | 431/313 |

*Primary Examiner*—Larry Jones
*Assistant Examiner*—Carl D. Price
*Attorney, Agent, or Firm*—Wenderoth, Lind & Ponack

[57] ABSTRACT

A liquid fuel combustion device which includes a fuel tank, a combustion section which includes an inner and an outer flame cylinder and an outer cylinder surrounding the flame cylinders, and a wick having one end in the fuel tank for being immersed in the liquid fuel therein and the other end disposed between the flame cylinders so as to draw fuel to the other end. Structure is also provided for guiding air through the combustion section to provide oxygen to support combustion between the flame cylinders of fuel evaporated from the wick such that the heat produced by the combustion serves to evaporate the fuel from the other end of the wick. Detector elements are provided for respectively detecting the temperature of the exhaust gas from the combustion section and the temperature of the air guided to the combustion section by the guide structure. Circuitry is provided for producing a signal indicative of the difference between the respective temperatures detected by the respective temperature detecting elements. An actuating section is provided to stop the combustion in the combustion section or give a warning when the difference the outputs of the detecting elements is below or above a predetermined value. In one embodiment of the invention, an electric heater is provided for assisting evaporation of fuel from the wick when the temperature difference detected by the temperature detecting elements is less than a predetermined value.

4 Claims, 10 Drawing Figures

LIQUID FUEL COMBUSTION DEVICE

BACKGROUND OF THE INVENTION

This invention relates to a liquid fuel combustion device of the type in which the gasification of fuel is continued by the heat of combustion produced by the device itself. As a phenomenon peculiar to this type of combustion device, a decreased oxygen concentration necessarily leads to a decreased rate of combustion which, in turn, leads to a decrease in the temperature of combustion exhaust gases. The invention relates to a liquid fuel combustion device designed with attention paid to this point to detect changes in the difference between the combustion exhaust gas temperature and room temperature so as to detect the oxygen-deficient state, thereby stopping the combustion or giving warning.

A conventional liquid fuel combustion device which discharges combustion exhaust gases into the room is liable to cause incomplete combustion as the oxygen concentration in the room decreases, which incomplete combustion, without the user knowing the state, e.g., while he is asleep, may cause carbon monoxide poisoning which, in the worst case, leads to death.

Recently, there have been proposed a device for oxidizing the noxious carbon monoxide to the harmless carbon dioxide with the aid of a catalyst or the like, and a method of detecting deficiency in oxygen by using a flame rod for detection of flame current. In the former, however, the oxygen concentration simply decreases, still involving a possibility of causing carbon monoxide poisoning, while in the latter the flame is liable to flare under the influence of the wind or the like, leading to frequent malfunction; thus, the method is lacking in reliability.

As for combustion devices using gas as fuel, there have been proposed methods including one for detecting deficiency in oxygen by using an element for detecting oxygen partial pressure or oxygen concentration gradient. This element is incorporated in the device such that it is under a high oxygen partial pressure or in a low oxygen concentration atmosphere during normal combustion. More particularly, the element is so set that it is positioned in flame flow during normal combustion and enters the flame which will elongate or lift owing to deficiency in oxygen.

Therefore, it is effective for the complete primary combustion system wherein when the oxygen becomes deficient, the flame elongates so that the oxygen partial pressure or oxygen concentration with respect to the normal operation sharply changes, that is, a condition is established in which it becomes easier to detect changes in oxygen partial pressure and concentration.

In liquid fuel combustion devices using liquid as fuel and particularly liquid fuel combustion devices of the self-heat gasification combustion type in which the gasification of fuel is effected by the heat of combustion produced by the device itself to continue the combustion, such as a stove and pot burner, even if the flame elongates in the case of deficiency in oxygen, such elongation takes place only instantaneously; usually, the flame decreases in size from the normal combustion state, that is, the rate of combustion is decreased. Therefore, if an oxygen change detecting element is provided in a liquid fuel combustion device of such self-heat gasification combustion type in a conventional manner, this will result in detection of the oxygen partial pressure or oxygen concentration gradient in the CO atmosphere downstream of the flame. In the case of an atmosphere-open type in which secondary air is supplied, secondary air migrates into the exhaust gases from downstream of the flame, producing little change in oxygen partial pressure or oxygen concentration gradient, so that it is almost impossible to detect the oxygen-deficient state; thus, it has been difficult to put said means into practical use.

SUMMARY OF THE INVENTION

Accordingly, an object of the invention is to provide a liquid fuel combustion device wherein changes in the temperature of combustion exhaust gases caused by the decrease of the rate of combustion are compared with the room temperature to detect a state in which the temperature difference reaches a given value, so as to detect the oxygen-deficient state, whereupon the combustion is stopped or warning is given.

Embodiments of the invention will now be described with reference to the accompanying drawings.

DETAILED DESCRIPTION OF THE PREFERRED EMBODIMENTS

Figure 1:
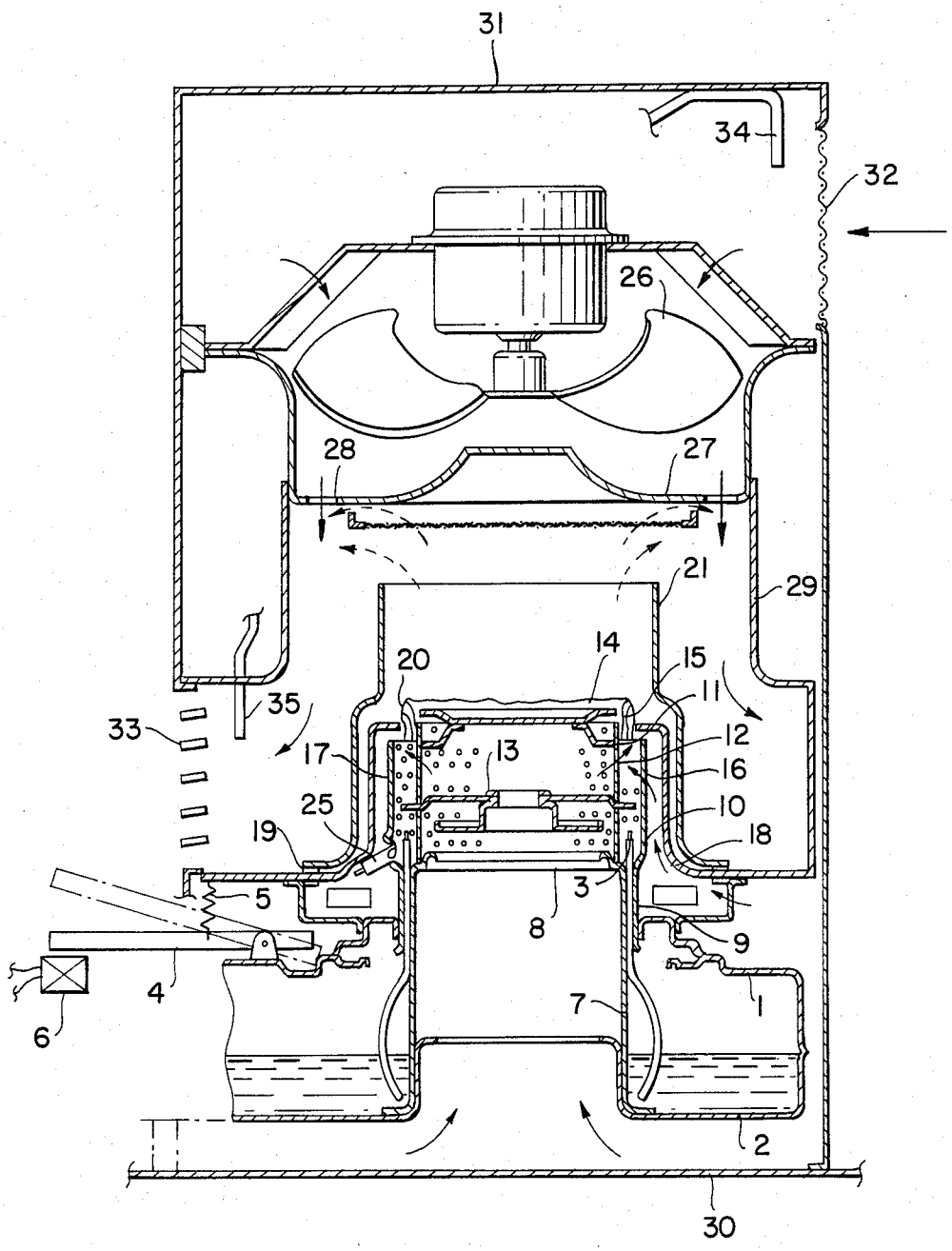
FIG. 1 is a longitudinal section of a liquid fuel combustion device according to an embodiment of the invention.

In FIG. 1, a cylindrical wick 3 has its lower portion immersed in liquid fuel 2 contained in a fuel tank 1 which is square in a plan view, said wick 3 sucking up the liquid fuel 2 by capillary action. The wick 3 is connected (connection not shown) to a lever 4 at the right-hand side of its pivot, with the upper portion of the wick normally positioned in the fuel tank. The lever 5 is pulled up by a spring 5 at the left-hand side of the pivot as shown in phantom lines. When the lever 4 is depressed as the left-hand side of the pivot, the wick 3 is moved to its upper position and the lever 4 is held in its depressed position, attracted by a solenoid 6 at the left-hand side of the pivot. The fuel tank 4 has a ventilation cylinder 7 projecting from the bottom to serve as a guide for the vertical slide movement of the wick 3. The upper portion of the ventilation cylinder 7 is formed with a ventilation port 8. An outer fire pan 9 is disposed around the upper portion of the wick 3, said fire pan 9 being formed with a number of ventilation holes 10.

An inner flame cylinder 11 is disposed above the ventilation cylinder 7 and is formed with a number of primary air supply holes 12. The inner flame cylinder 11 is provided with a partition plate 13 and a flame spreading plate 14, and a slit air opening for secondary combustion air supply is defined between the flame spreading plate 14 and the upper end of the inner flame cylinder. The inner flame cylinder 11 is surrounding by an outer flame cylinder 16 having a number of primary air supply holes 17, which cylinder 16 is surrounded by an outer cylinder 18 having a tertiary air supply hole 19, and a slit-like air opening 20 through which secondary air flow is defined between the upper end of the inner flame cylinder 11 and the upper end of the outer cylinder 18. The outer cylinder 18 is surrounded by a combustion cylinder 21, with a clearance defined therebetween for passage of tertiary air. An ignition heater (igniter) 25 is installed in said outer fire pan 9.

A fan 26 is installed above the combustion cylinder 21 with a disk-like air flow partition plate 27 interposed therebetween. Thus, the air from the fan 26 passed through a ring-like ventilation port 28 and is guided by a blow guide 29 so that it blows out downwardly.

A case 31 is installed on a base 30 disposed below the fuel tank 1, so as to cover the combustion cylinder 21 and fan 26, said case being formed with a suction port 32 and a blow-out port 33. Temperature detecting elements 34 and 35 (hereinafter referred to briefly as elements), such as thermistors, and disposed in close vicinity to said suction port 32 and blow-out port 33, the difference between the temperatures detected by the elements 34 and 35 being utilized to detect deficiency in oxygen.

Figure 3:
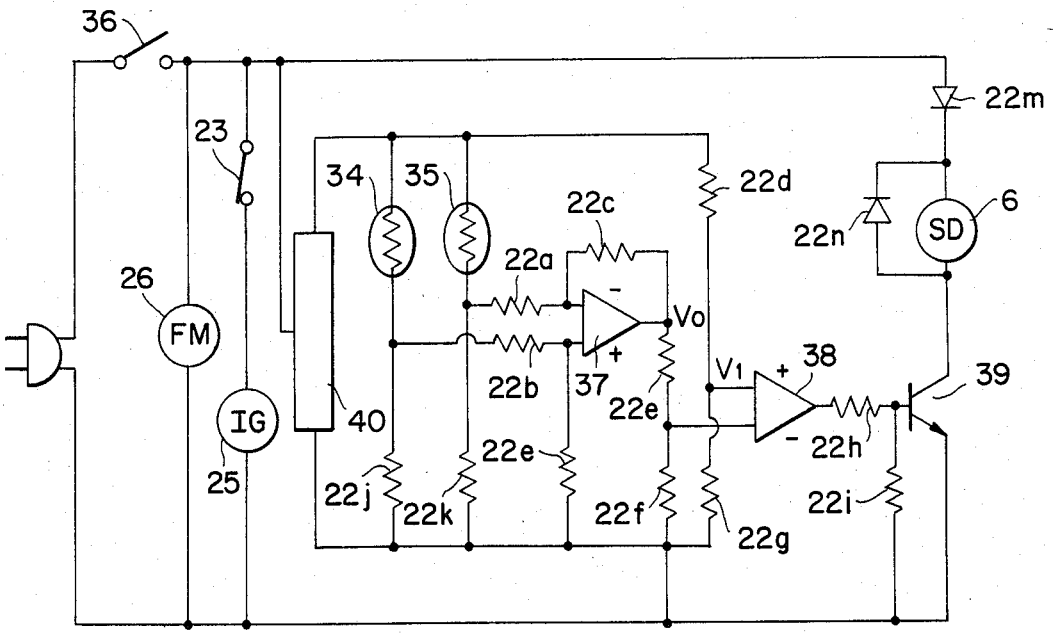
FIG. 3 is a diagram of electric circuitry for said device.

FIG. 3 shows circuitry for detecting deficiency in oxygen by the elements 34 and 35. A power switch 36 is closed when the lever 4 for vertical movement of the wick is depressed at the left-hand side of the pivot. The output voltage produced by the difference between the temperatures detected by the elements 34 and 35 is amplified by an operational amplifier 37 and the amplified voltage is compared with the base voltage by a comparator 38 so as to turn on and off the output voltage. A transistor 39 is adapted to be opened and closed by the output voltage from the comparator 38 to control the solenoid 6. The circuitry is adapted to be operated by a power source 40 from a DC power circuit having resistors 22*a*–22*l*. The igniter 25 has a switch 23 connected thereto. The circuit further has diodes 22*m* and 22*n*.

In operation, when the lever 4 is depressed at the left-hand side of the pivot, the wick 3 is upwardly moved until its upper end is positioned above the outer fire pan 9, the wick being maintained in this position by the attraction of the solenoid 6. The liquid fuel sucked up from the tank 1 is burned by ignition effected by the igniter 25. Simultaneously therewith, the fan 26 is rotated and the air flows through the ring-like ventilation port 28 formed in the outer peripheral portion of the air flow partition plate 27, and along the blow guide 29 and it is downwardly blown out, as shown by arrows in solid line in FIG. 1. At this time, the combustion exhaust gases are drawn in as shown in broken line in FIG. 1 by the venturi effect produced by the air being blown out and are mixed with the air from the fan 26 and blown out into the room through the blow-out port 23.

On the other hand, combustion air is sucked in through the ventilation port 8 in the ventilation cylinder 7 by said venturi effect.

Figure 2:
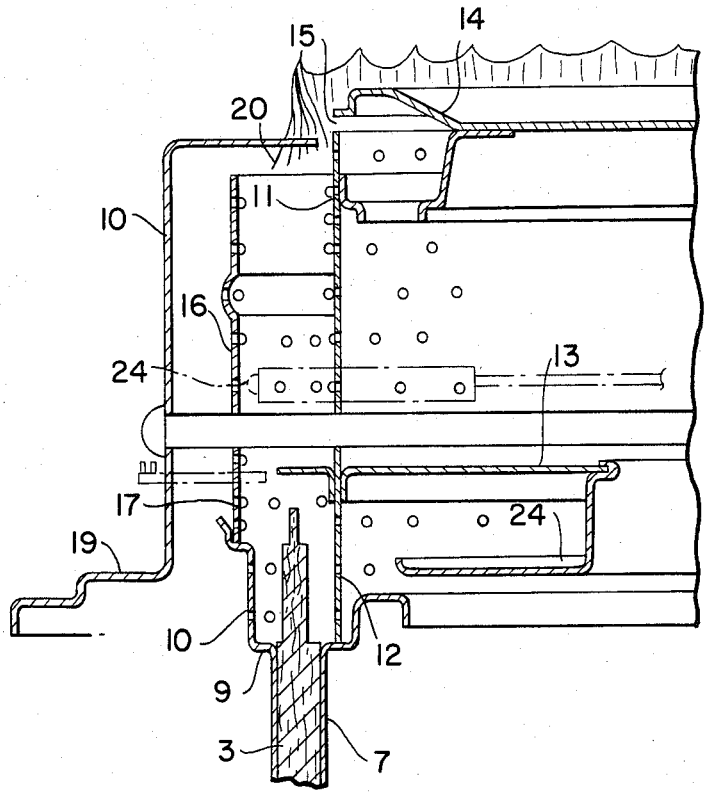
FIG. 2 is an enlarged sectional view of the combustion section of said device.

Combustion is effected in the primary air supply ports 12 and 17 and unburned combustion gas is burned above the outer flame cylinder 16, as shown in FIG. 2.

Figure 5:
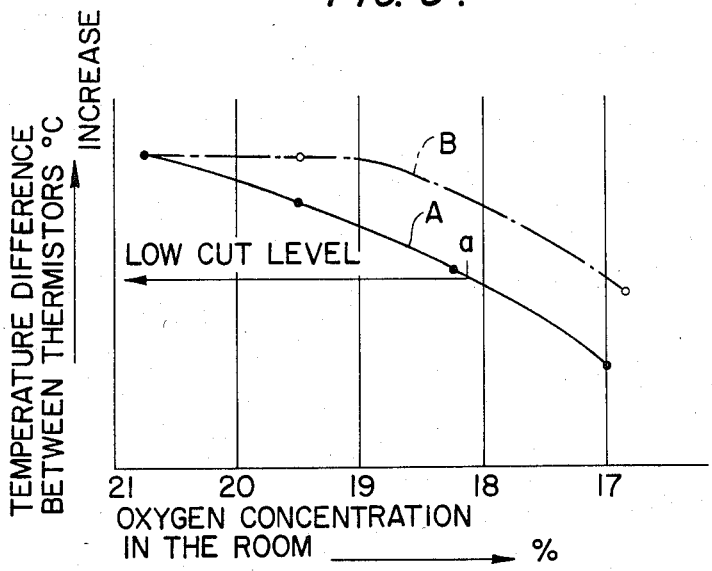
FIG. 5 is a graph showing changes in temperature difference between two elements due to deficiency in oxygen.

When deficiency in oxygen starts to occur, the combustion flames formed at the primary air supply holes 12 and 17 in the inner and outer flame cylinders 11 and 16 are reduced in size as the reaction of combustion is weakened owing to the deficiency in oxygen, so that the number of those primary air supply holes 12 and 17 at which flames are not formed increases and incomplete combustion takes place. This is because while, normally, the blowing rate of the primary air supplied from the primary air supply holes 12 and 17 is balanced by the combustion rate of flames formed at the primary air supply holes 12 and 17, so that flames are formed at substantially all of the primary air supply holes 12 and 17, deficiency in oxygen results in a decreased rate of combustion of flame, so that the blowing rate of the air supplied from the primary air supply holes 12 and 17 becomes greater, or strictly speaking, it lifts, causing the flames formed at the primary air supply holes 12 and 17 to die away. When the flames formed at the primary air supply holes 12 and 17 in the inner and outer flame cylinders 11 and 16 are decreased in number, the amount of heat supplied to the wick 3 is also decreased, and the rate of gasification of fuel from the wick 3 is decreased, lowering the rate of heat generation. As the rate of heat generation is lowered, the temperature of the combustion exhaust gases, i.e., the temperature detected by the element 35 installed at the blow-out port 33 also drops. However, since the room has already been warmed to a certain temperature even if there is a drop in the temperature of said combustion exhaust gases, there is not so much drop in the temperature detected by the element 34 installed at the suction port 32 as said temperature drop of the combustion exhaust gases, so that the temperature detected by the element 34 is kept substantially constant. As a result, the difference in temperature between the elements 34 and 35 is gradually decreased as the oxygen-deficient state becomes more pronounced, as indicated by a line a in FIG. 5. Therefore, if it is so arranged that the output from the comparator 38 is cut off at an oxygen concentration a which will result in a dangerous state, then it is possible to deenergize the solenoid 6 through the transistor 39 so as to lower the wick 3 and put out the fire.

Figure 4:
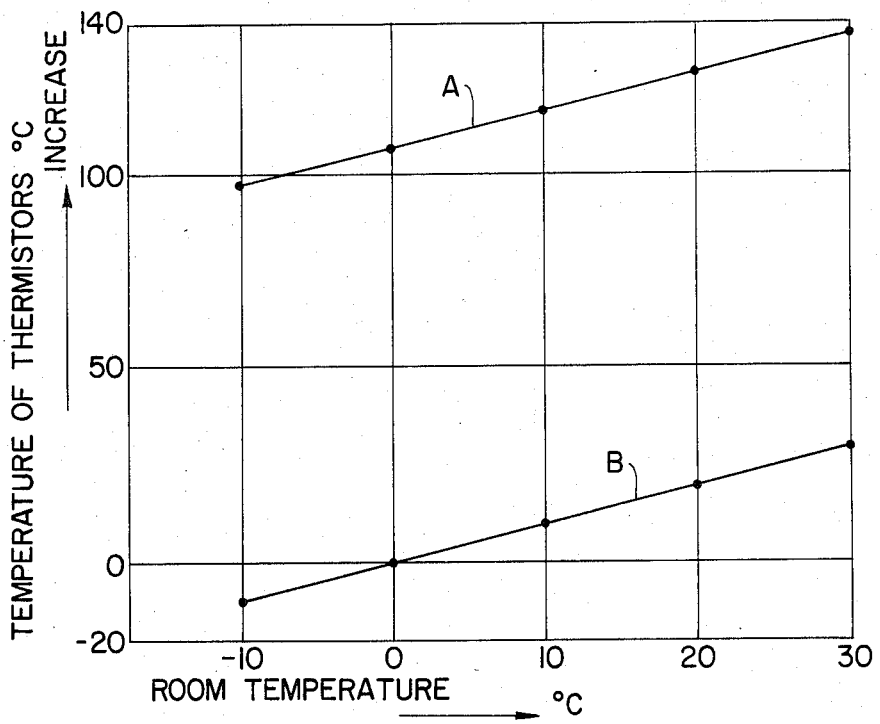
FIG. 4 is a graph showing changes in the temperature of an element due to changes in room temperature.

FIG. 4 shows changes in the temperature of the element 35 due to changes in room temperature, wherein A indicates the temperature of the element, i.e., changes in the combustion exhaust gas temperature. The combustion exhaust gas temperature will change also with room temperature. Therefore, if the device is operated with only the temperature of the combustion exhaust gases detected, a problem arises that even if the air in the room is exchanged with fresh air for the purpose of ventilation and hence the room temperature drops, it treats this situation as a deficiency in oxygen, i.e., it malfunctions.

However, if the element 34 for detecting the room temperature is used and the difference in temperature between the two elements 34 and 35 is used as output, there is no possibility of such malfunction. That is, as shown by graph line B, in FIG. 4, the temperature of the element 34 also changes with the room temperature. Therefore, even if the room temperature changes, the difference between the room temperature and the combustion exhaust gas temperature detected by the element 35 is substantially constant; said temperature difference changes only when the combustion state is degraded. Therefore, malfunctions due to changes in room temperature are eliminated, and deficiency in oxygen can be positively detected.

Figure 6:
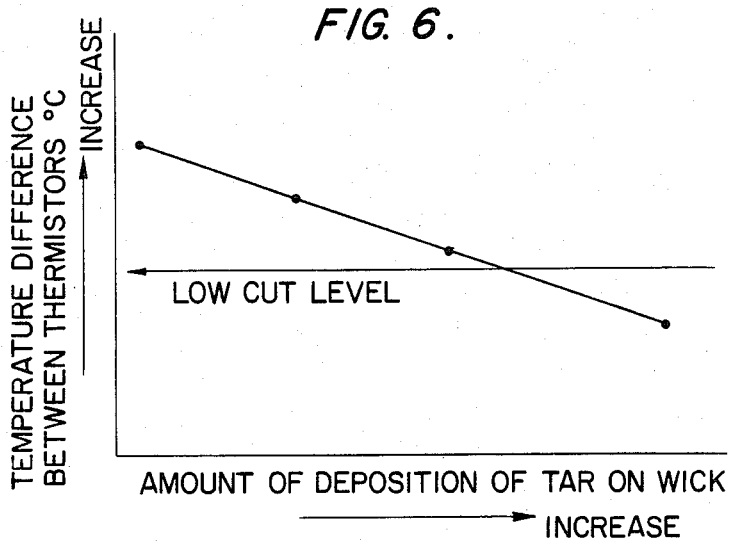
FIG. 6 is a graph showing changes in temperature difference between the two elements due to the formation of tar.

Further, the decrease of the combustion rate due to degradation of the combustion state takes place also when tar forms on the wick 3 to decrease its ability to suck up fuel. Therefore, abnormal combustion due to the formation of tar can also be detected. FIG. 6 shows changes in the difference in temperature between the two elements 34 and 35, and it is seen that said changes have the same tendency as at the time of deficiency in oxygen, so that abnormal combustion due to the formation of tar can be detected.

Figure 7:
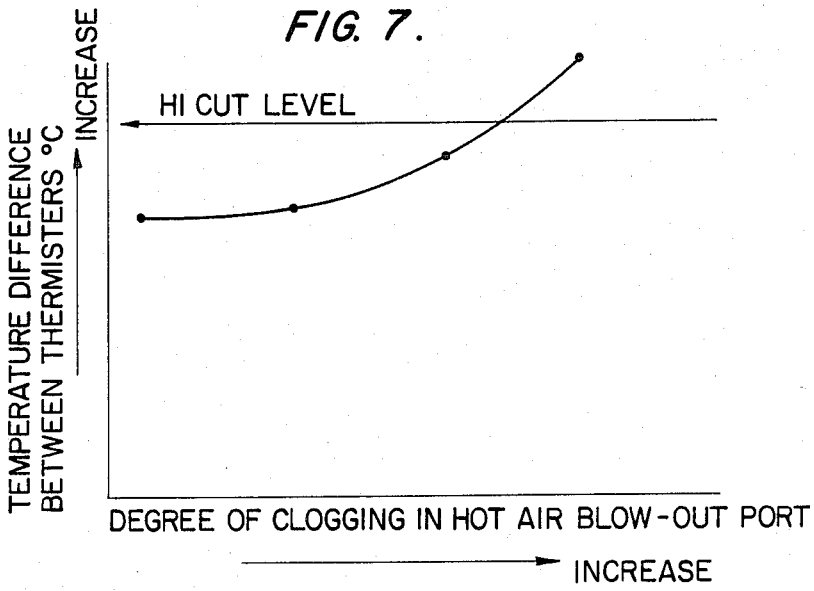
FIG. 7 is a graph showing changes in temperature difference between the two elements due to the clogging of a delivery port.

FIG. 7 shows changes in the difference in temperature between the elements 34 and 35 in the case of a backfire due to reverse wind or the like. In this case, the difference in temperature increases. Therefore, if it is so arranged that the output from the comparator 38 is cut off also when the temperature difference exceeds a certain value, it is possible to stop the combustion, as in the previous case, so that fires due to overheating can be prevented from occurring.

Figure 8:
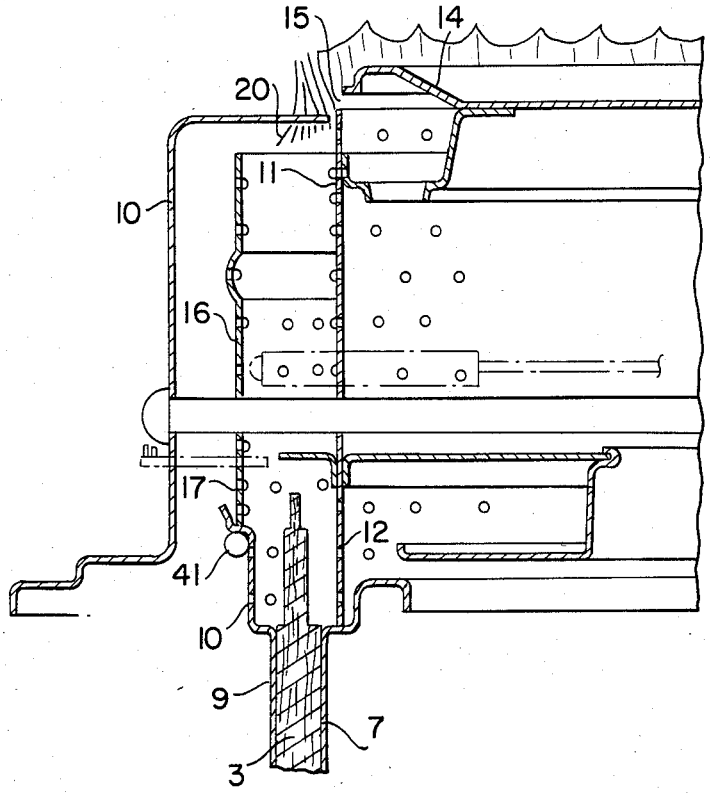
FIG. 8 is an enlarged sectional view of the combustion section of a liquid fuel combustion device according to another embodiment of the invention.

Another embodiment of the invention will now be described with reference to FIGS. 8 and 9. In this embodiment, the accuracy of detection of deficiency in oxygen is further improved. In the preceding embodiment described above, once the combustion rate starts to decrease owing to deficiency in oxygen, it decreases so rapidly that although the oxygen-deficient state has not advanced very much, the difference in temperature between the elements 34 and 35 reaches a level which stops combustion, causing premature stoppage.

Figure 10:
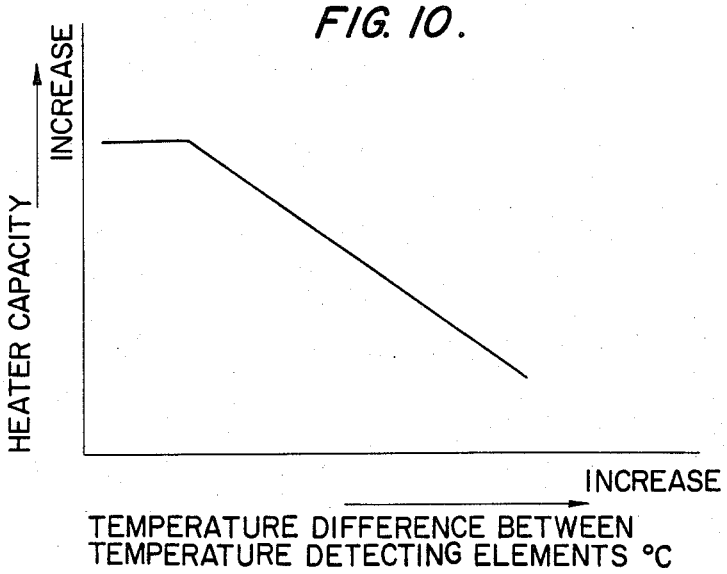
FIG. 10 is a graph showing the relation between elements and heater capacity.

Therefore, in this embodiment, an electric heater 41 for assisting in gasification and combustion is provided around the outer fire pan 9. Thus, by controlling the energization of the electric heater 41 by the outputs from the elements 34 and 35, said premature stoppage is prevented. More particularly, as shown in FIG. 9, the output end of the operational amplifier 37 for amplifying the output voltages from the elements 34 and 35 is connected to a comparator 42, separate from the comparator 38 for driving said solenoid, the output end thereof being connected to the gate of a thyristor 44 connected in series with the electric heater 41 through a transistor 43. As a result, when the difference in temperature between the elements 34 and 35 starts to be lower than the value for normal combustion, the current to the electric heater 41 increases, as shown in FIG. 10, to compensate for the rapid decrease of the combustion rate. The combustion initially is substantially maintained at the rated value of the device by said compensation, but is eventually decreased by deficiency in oxygen until the difference in temperature between said two elements 34 and 35 reaches a value determined by the warning oxygen concentration a, at which time the comparator 38 for the solenoid is turned off to stop the combustion. As shown by graph curve B in FIG. 5, the difference in temperature between the elements 34 and 35 remains substantially unchanged until an oxygen concentration of about 19% is reached, and then it starts to change. Thus, the problem of premature stoppage is eliminated. (In this embodiment, the cut level a is set a little closer to the side associated with higher temperature difference).

Figure 9:
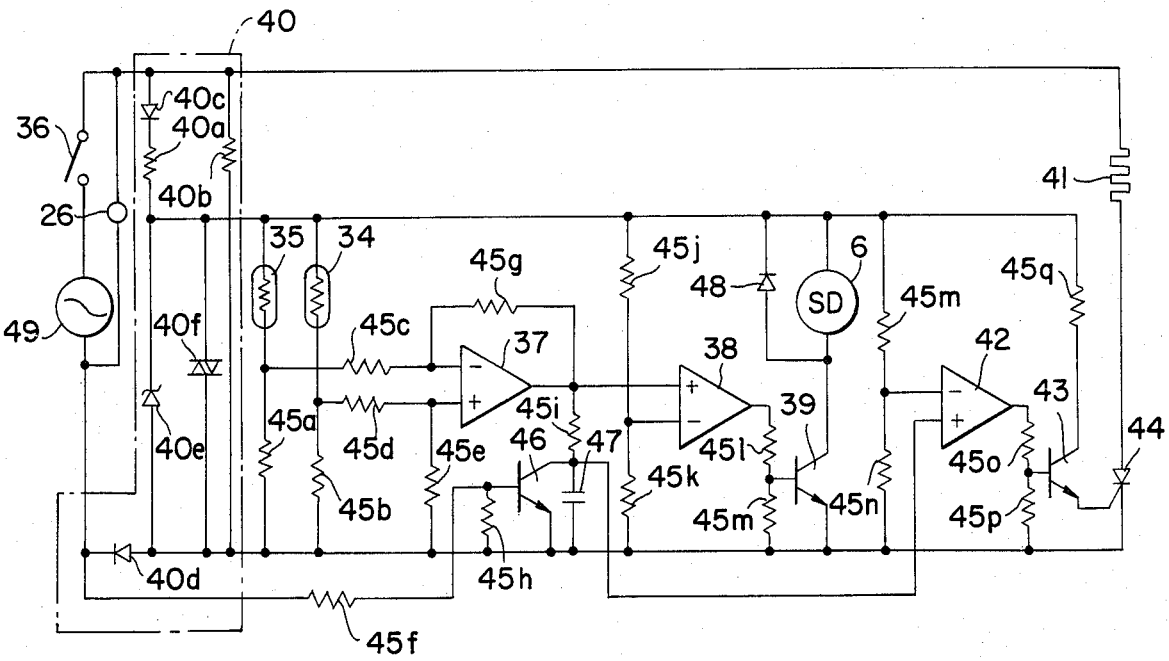
FIG. 9 is a diagram of electric circuitry for said device.

In FIG. 9, the DC power circuit 40 has resistors 40*a*, 40*b*, diodes 40*c*, 40*d*, Zener diode 40*e*, and capacitor 40*f*, and the oxygen-deficient state detecting and operating section has connected thereto resistors 45*a*–45*q*, transistor 46, capacitor 47, and diode 48. The AC power source 49 is turned on by the power switch 36.

In the embodiments described above, the element 34 for detecting the room temperature is disposed at the suction port 32 of the fan 26, but it may be located at a suitable place in the ventilation cylinder 7 or in the room. The form of combustion is not limited to the wick type, and other forms may be used. Further, in the above embodiments, the operating section which operates by detecting deficiency in oxygen has been described where the combustion stopping means is in the form of the solenoid 6 for attracting and holding the lever 4, but said means may be replaced by warning means such as a lamp or buzzer to warn the user of the oxygen-deficient state.

As has been described so far, according to the present invention, accidents due to deficiency in oxygen can be prevented and the operation can be made reliable, and abnormal combustion due to tar formation and reverse wind can also be detected.

We claim:

1. A liquid fuel combustion device comprising:

a fuel tank for containing liquid fuel;

a combustion section including a first flame cylinder, a second flame cylinder surrounding said first flame cylinder, and an outer cylinder surrounding said first and second flame cylinders;

a wick having one end in said fuel tank for being immersed in the liquid fuel and the other end disposed between said first and second flame cylinder so as to draw the fuel to said other end;

means for guiding a flow of air to said combustion section to provide oxygen at said other end of said wick to support combustion between said first and second flame cylinders of fuel evaporated from said other end of said wick, such that the heat produced by the combustion serves to evaporate the fuel from said other end of said wick;

means, having an oxygen level indicative output, for detecting the oxygen level in the air guided to said combustion section by said guiding means, said oxygen level detecting means including:

first temperature detecting means for detecting the temperature of combustion exhaust gas resulting from combustion in said combustion section, second temperature detecting means for detecting the temperature of the air guided to said combustion section by said guiding means, and means for producing a temperature difference signal indicative of the difference between the respective temperatures detected by said first and second temperature detecting means;

means, adjacent said wick, for electrically heating the liquid fuel; and means, responsive to said oxygen level indicative output, for energizing said electrically heating means so as to assist evaporation of liquid fuel from said wick, when the oxygen level in the air guided to said combustion section is below a first level, and for stopping combustion of fuel in said combustion section when the oxygen level is below a second level below said first level;

said energizing and stopping means including means, responsive to said temperature difference signal, for energizing said electrically heating means when the temperature difference is below a first temperature value, and for stopping combustion of fuel in said combustion section when the temperature difference is below a second temperature value below said first temperature value.

2. A fuel combustion device as in claim 1, wherein said guiding means includes a ventilation cylinder upstanding in said fuel tank.

3. A liquid fuel combustion device comprising:

a fuel tank for containing liquid fuel;

a combustion section including a first flame cylinder, a second flame surrounding said first flame cylinder and an outer cylinder surrounding said first and second flame cylinders;

a wick having one end in said fuel tank for being immersed in the liquid fuel and the other end disposed between said first and second flame cylinders so as to draw the liquid fuel to said other end;

means for guiding a flow of air through said combustion section to provide oxygen at said other end of said wick to support combustion between said first and second flame cylinders of fuel evaporated from said other end of said work, such that the heat produced by the combustion serves to evaporate the liquid fuel from said other end of said wick;

means, having an oxygen level indicative output, for detecting the oxygen level in the air guided to said combustion section by said guiding means, said oxygen level detecting means including:

first temperature detecting means for detecting the temperature of combustion exhaust gas resulting from combustion in said combustion section, second temperature detecting means for detecting the temperature of the air guided to said combustion section by said guiding means, and means for producing a temperature difference signal indicative of the difference between the respective temperatures detected by said first and second temperature detecting means;

means, adjacent said wick, for electrically heating the liquid fuel; and means, responsive to said oxygen level indicative output, for energizing said electrically heating means so as to assist evaporation of liquid fuel from said wick, when the oxygen level in the air guided to said combustion section is below a first level, and for producing a warning signal when the oxygen level is below a second level below said first level;

said energizing and signal producing means including means, responsive to said temperature difference signal, for energizing said electrically heating means when the temperature difference is below a first temperature value, and for producing a warning signal when the temperature difference is below a second temperature value below said first temperature value.

4. A fuel combustion device as in claim 3, wherein said guiding means includes a ventilation cylinder upstanding in said fuel tank.

* * * * *